US006115944A

United States Patent [19]

Lain

[11] Patent Number: 6,115,944

[45] Date of Patent: Sep. 12, 2000

[54] DYNAMIC DUAL DENSITY HEEL BAG

[76] Inventor: Cheng Kung Lain, 2092 14th Ave., San Francisco, Calif. 94116

[21] Appl. No.: 09/188,132

[22] Filed: Nov. 9, 1998

[51] Int. Cl.[7] ..... A43B 21/26

[52] U.S. Cl. ..... 36/35 R; 36/28

[58] Field of Search ..... 36/28, 29, 25 R, 36/31, 35 R, 37, 71

[56] References Cited

U.S. PATENT DOCUMENTS

| | | | |
|---|---|---|---|
| 3,736,613 | 6/1973 | Tusa et al. | 12/142 D |
| 4,020,569 | 5/1977 | Fukuoka | 36/29 |
| 4,224,746 | 9/1980 | Kim | 36/44 X |
| 4,730,402 | 3/1988 | Norton et al. | 36/32 R X |
| 4,798,010 | 1/1989 | Sugiyama | 36/31 X |
| 4,918,841 | 4/1990 | Turner et al. | 36/28 X |
| 5,224,280 | 7/1993 | Preman et al. | 36/30 R |
| 5,572,805 | 11/1996 | Giese et al. | 36/31 X |
| 5,704,137 | 1/1998 | Dean et al. | 36/28 |

*Primary Examiner*—B. Dayoan
*Attorney, Agent, or Firm*—John S. Christopher

[57] ABSTRACT

A dynamic dual density heel bag for use in shoe construction and typically employed in athletic and walking type shoes. The dynamic dual density heel bag includes a construction including a lower flexible sealed enclosure containing a high density material where the lower enclosure has a V-shaped top surface. Also included is an upper flexible sealed enclosure containing a low density material. The upper enclosure has a V-shaped bottom surface for being vertically cradled by and affixed to the V-shaped top surface of the lower enclosure for forming a heel bag. The heel bag is then affixed within an outsole of a shoe typically with an adhesive. The high density material of the lower enclosure is isolated from the low density material of the upper enclosure. Thus, the low density material of the upper enclosure provides cushioning and shock absorption and the high density material of the lower enclosure provides support, security and stability to a foot. The lower enclosure and the upper enclosure of the dynamic dual density heel bag can contain high density silicon and low density silicon, respectively, and each can be comprised of plastic. Further, the upper enclosure can be affixed to the lower enclosure as by heat sealing or adhesives. In an alternative embodiment, the dynamic dual density heel bag can be modified to support the entire sole of the shoe in addition to the heel area.

11 Claims, 3 Drawing Sheets

FIG. 1
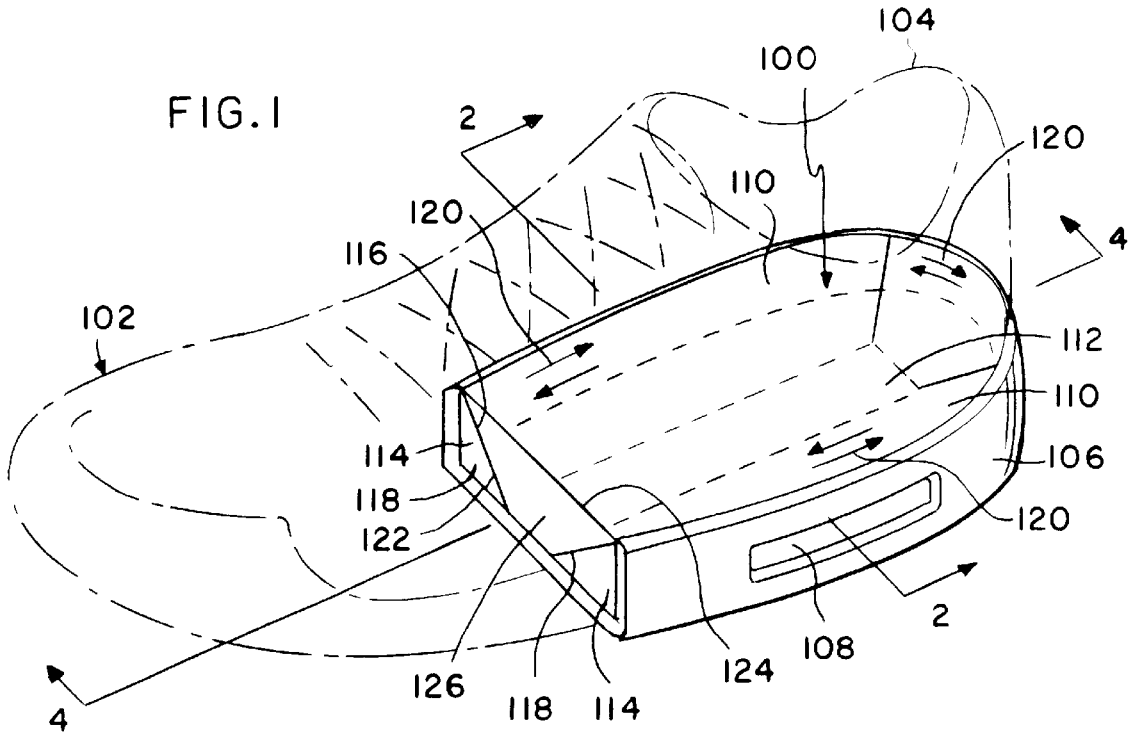
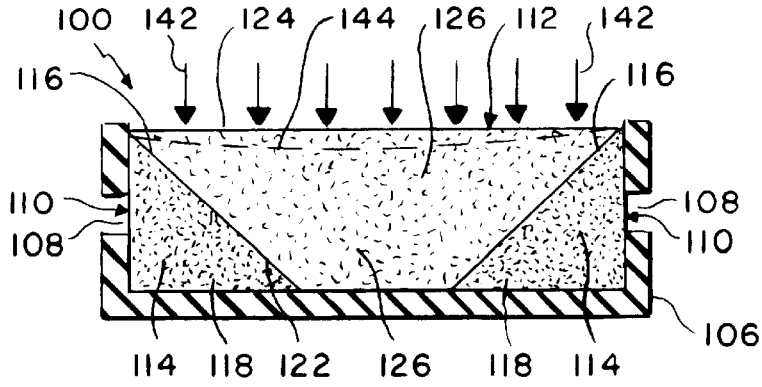
FIG. 2

DYNAMIC DUAL DENSITY HEEL BAG

BACKGROUND OF THE INVENTION

1. Field of the Invention

The present invention relates to shoe construction. More specifically, the present invention relates to methods and apparatus for a dynamic dual density heel bag for use in athletic and walking type shoes to provide cushioning and shock absorption to the foot to enhance comfort and support, security and stability to the foot for avoiding sprained ankles.

2. Description of the Related Art

The relevant art is directed to means and methods of constructing footwear to improve the comfort to the human foot. Much effort has been expended in designing sole and heel shoe components which are comfortable yet robust exhibiting a tough construction which yields to the movements of the human foot.

In one example, a method to manufacture a welted article of footwear is disclosed in which a shaped board is temporarily secured to one side of a flexible insole prior to the securing of a lasted upper to the insole. The flexible insole is formed with extended marginal portions which in the finished article of footwear extend up the sides of the upper so as to cradle the foot. The welted article of footwear also includes a cushioning structure comprising a rib member made of a rubbery material which surrounds a resilient filling of sponge rubber. The rib member surrounds or bounds the sponge rubber filling but does not cradle it.

In another example, a shoe has a shock-absorbing structure comprising a hydrodynamic pad positioned within the midsole of the shoe. The hydrodynamic pad includes inner and outer fluid-filled bladders which are interconnected by fluid channels and configured such that displacement of fluid from the center of pressure distribution generated by foot impact radiates from the inner bladder outwardly to the outer bladder through the fluid channels. This action causes the outer bladder to expand for seating the heel of the foot. The hydrodynamic pad cushions and stabilizes the foot by a controlled displacement of fluid between the inner bladder and the outer bladder which are located in the same plane and are interconnected to pass a fluid of constant density. Pressure applied to the inner bladder by the foot forces constant density fluid through the channels to the outer bladder. The outer bladder is positioned outwardly from the inner bladder, i.e., the pair of bladders are not vertically stacked and are not isolated from one another.

Another example teaches a sandal with a soft sole body formed of non-rigid plastic material having a relatively hard non-foamy surface layer with soft pliable surface inside. The sole is provided with a plurality of recesses used for air distribution to a foot. A reinforcing plate, which serves as an insole, is formed of rigid polyvinylchloride (PVC) plastic material having a suitable thickness to prevent flexion on the rear half. Thus, the top layer is the reinforcing plate comprised of rigid PVC and the bottom layer is the sole comprised of non-rigid plastic with a soft pliable surface inside.

A further example teaches a resilient member adapted for use within the sole of an article of footwear and buried within multiple layers of a polyurethane foam positioned over the full length and width of the sole. Materials other than polyurethane foam can be used as long as the substitute material is sufficiently hard to provide adequate shock absorption and soft enough to provide sufficient cushioning and comfort. Windows are included in the footwear to enable the resilient material to be viewed from the exterior of the shoe. A main feature in this example is a resilient member, the function once compressed by the foot is to quickly return substantially to its unstressed position to return substantial amounts of energy to the foot quicker than could be provided by polyurethane foam. The cradling effect of an upper layer of polyurethane foam is the result of the vertical portions of the resilient member and the cradle element.

Several problems associated with the foregoing footwear designs include multiple bladders which are located in the same plane and use fluids of constant density. Consequently, the two bladders will function with the same parameters instead of one bladder serving as a cushioning medium and a second bladder located in another plane serving as a stabilizing medium. Additionally, multiple bladders located in the same plane necessarily require that the bladders be smaller (than vertically-stacked bladders) and thus less effective. In constructions which utilize sponge rubber, adequate cushioning is not realized. Further, in cases which utilize multiple interconnected bladders, use of fluids of different densities is not possible.

Thus, there is a need in the art for a dynamic dual density heel bag for use in shoe construction that includes a lower sealed enclosure which contains a stiff dynamic high density material for providing support and stability to a foot, a separate upper sealed enclosure which contains a shock-absorbing low density material for providing cushioning to the foot, where the upper enclosure is cradled by and sealed to the lower enclosure to form the heel bag that is affixed within the outsole of a footwear.

SUMMARY OF THE INVENTION

Briefly, and in general terms, the present invention provides a new and improved dynamic dual density heel bag for use in the construction of athletic and walking type shoes. The novel and non-obvious dynamic dual density heel bag exhibits a robust lightweight design which is useful in improving the cushioning and shock absorption, support, security and stability that a shoe provides to the human foot.

The inventive dynamic dual density heel bag includes a lower flexible sealed enclosure which has a top surface that is V-shaped and one end of the body of the lower enclosure assumes a U-shaped form. The lower enclosure includes an interior channel that carries a high density material that responds to dynamic compression applied to the heel bag. Mounted directly above the lower enclosure is an upper flexible sealed enclosure which exhibits a bottom V-shaped surface that corresponds to the V-shaped top surface of the lower enclosure. The upper enclosure carries a low density material suitable to act as a cushioning medium. Because of this design, the lower enclosure functions to cradle the upper enclosure and when the two are affixed together, the combination forms the heel bag which is then affixed within an outsole of an athletic or walking shoe. Although the lower flexible sealed enclosure is affixed to the upper flexible sealed enclosure, the two enclosures are not interconnected. Thus, the high density material of the lower enclosure is isolated from the low density material of the upper enclosure. This design enables the low density material to provide cushioning and shock absorption and the high density material to provide support, security and stability to the foot.

The dynamic dual density heel bag of the present invention is generally directed to shoe construction and is typically employed in athletic and walking type shoes. In its most fundamental embodiment, the dynamic dual density heel bag comprises a construction including a lower flexible sealed enclosure containing a high density material where the lower enclosure has a V-shaped top surface. Also included is an upper flexible sealed enclosure containing a low density material. The upper enclosure has a V-shaped bottom surface for being vertically cradled by and affixed to the V-shaped top surface of the lower enclosure for forming a heel bag. The heel bag is then affixed within an outsole of a shoe. The high density material of the lower enclosure is isolated from the low density material of the upper enclosure. Thus, the low density material of the upper enclosure provides cushioning and shock absorption and the high density material of the lower enclosure provides support, security and stability to a foot.

In a preferred embodiment, the lower enclosure and the upper enclosure of the dynamic dual density heel bag can contain high density silicon and low density silicon, respectively, and each can be comprised of plastic. Further, the upper enclosure can be affixed to the lower enclosure as by heat sealing or adhesives. Additionally, the heel bag can be affixed to the inside of the outsole by an adhesive. In an alternative embodiment, the dynamic dual density heel bag can be modified to support the entire sole of the shoe in addition to the heel area.

These and other objects and advantages of the present invention will become apparent from the following more detailed description, taken in conjunction with the accompanying drawings which illustrate the invention, by way of example.

BRIEF DESCRIPTION OF THE DRAWINGS

FIG. 1 is a side perspective view of a dynamic dual density heel bag of the present invention showing an upper enclosure containing a shock-absorbing low density material cradled within a lower enclosure containing a stiffer high density material, the entire dynamic dual density heel bag shown within an outsole of a shoe where the shoe is shown in phantom.

FIG. 2 is a lateral cross-sectional view of the dynamic dual density heel bag taken along line 2—2 of FIG. 1 showing the upper enclosure containing the low density material cradled within and sealed to the lower enclosure containing the high density material, the dynamic dual density heel bag shown positioned within an outsole which includes viewing windows.

DESCRIPTION OF THE INVENTION

The present invention is a dynamic dual density heel bag 100 as shown in FIGS. 1–4 for use in athletic and walking type shoes for improving the comfort associated therewith. The dynamic dual density heel bag 100 of the present invention is typically employed to provide cushioning, shock absorption, support, security and stability in shoes normally used in athletic and walking type activities. The heel bag 100 is not an insert but is incorporated into a shoe during the manufacturing stage.

Figure 3:
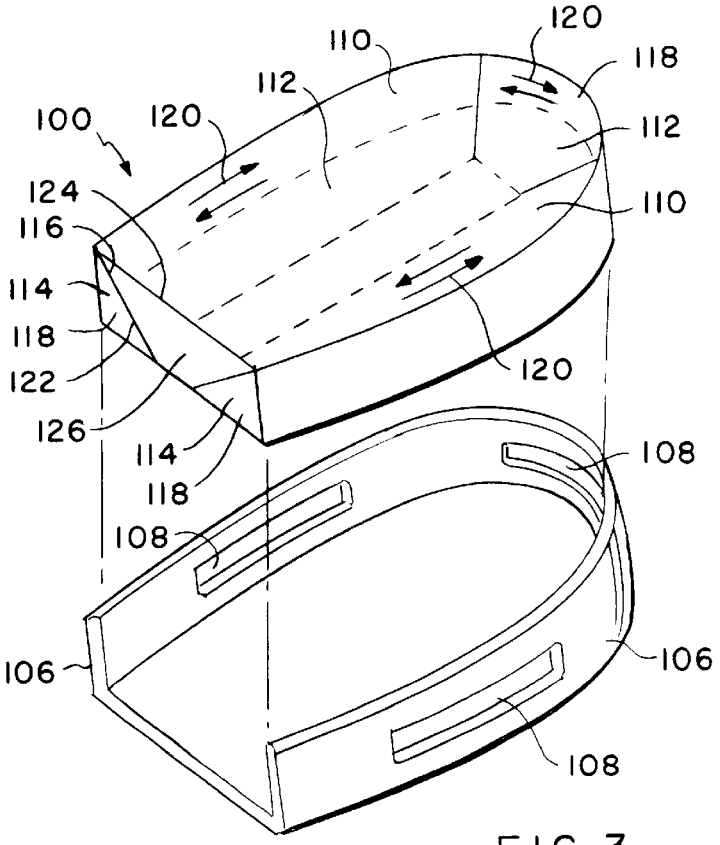
FIG. 3 is an exploded view of the dynamic dual density heel bag and surrounding outsole of FIG. 1 showing the upper enclosure containing the low density material affixed to the lower enclosure containing the high density material separated from the surrounding outsole of the heel of the shoe.
Figure 4:
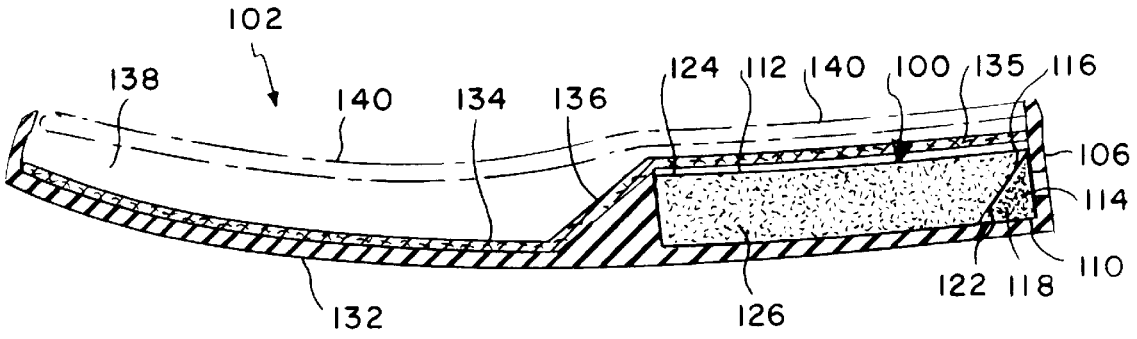
FIG. 4 is a longitudinal cross-sectional view of the dynamic dual density heel bag taken along line 4—4 of FIG. 1 showing the upper enclosure containing the low density material resting against the rear portion of the lower enclosure containing the high density material, the heel bag shown positioned within the outsole of the shoe.
Figure 5:
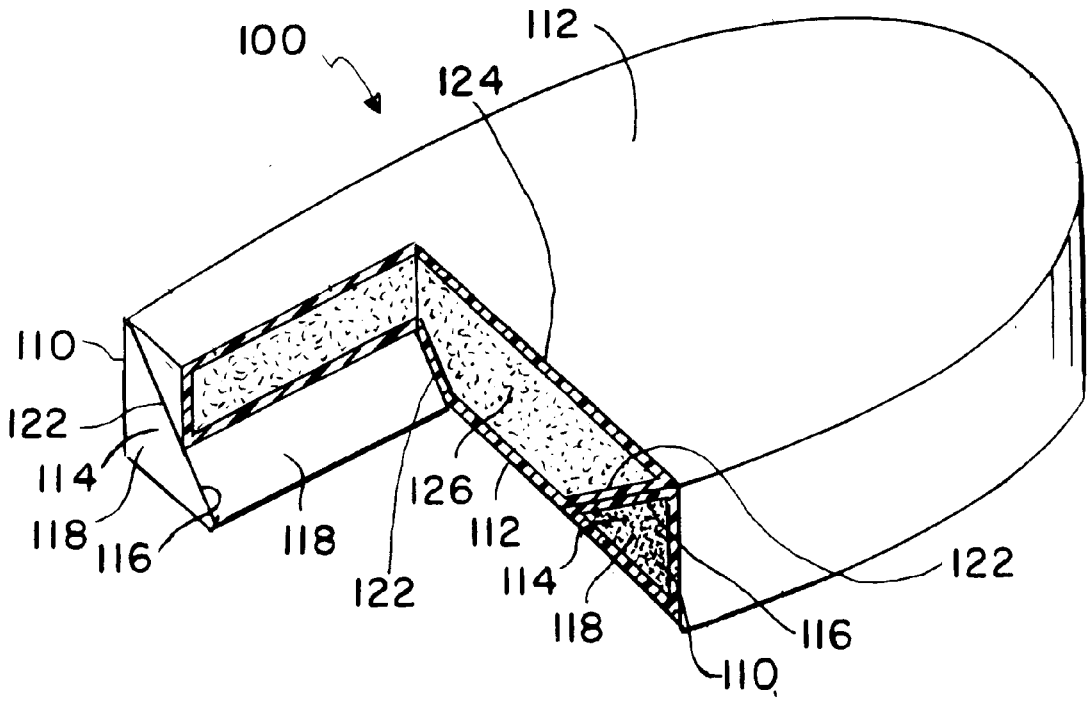
FIG. 5 is a prespective view partly in cross-section of the Dynamic Dual Density Heel Bag of the present invention showing the upper enclosure as being sealed and separate from the lower enclosure which is also shown as sealed.

A preferred embodiment of the dynamic dual density heel bag 100 is best shown in FIG. 3 and also in FIGS. 1, 2 and 4. The heel bag 100 is shown in the environment of an athletic shoe 102 illustrated in phantom in FIG. 1. The phantom illustration of the athletic shoe 102 shows the typical components including the upper portion 104 and outsole 106. The invention is directed to the heel bag 100 that is built into the outsole 106 of the shoe 102 and thus only that portion of the outsole 106 surrounding the inventive heel bag 100 is shown solid in FIGS. 1 and 3. It should be noted that the inventive heel bag 100 can be expanded into a foot bag (not shown), if desired.

The outsole 106 serves as an outer shell positioned around the perimeter of the shoe 102. The heel bag 100 is seated within and typically affixed with an adhesive to the interior of the outsole 106 during the manufacturing stage. Thus the heel bag 100 is not an insert for existing shoes. The outsole 106 can be comprised of rubber, polyurethane or a material known in the art as "TPR" which is a member of the plastics family. The height of the outsole 106 surrounding the heel portion of the shoe 102 is directly related to the thickness of the heel bag 100 (or in the alternative, a foot bag, not shown) since the thickness of the heel bag 100 can be varied depending upon the application. The outsole 106 can include a plurality of viewing windows 108 which enable one to determine if the heel bag 100 is properly charged with supporting material.

The dynamic dual density heel bag 100 is comprised of two separate enclosures which can be affixed together by heat sealing or with, for example, an adhesive (not shown). The first of the two separate enclosures is a lower flexible sealed enclosure 110 and the second of the two separate enclosures is an upper flexible sealed enclosure 112. The lower enclosure 110 includes a V-shaped top surface as is best shown in FIG. 2 and can be comprised of any suitable material such as flexible plastic. The bottom of the lower enclosure 110 is shaped in the form of a heel of a human foot so that it fits within the outsole 106 as shown in FIG. 3. The lower enclosure 110 is charged with a high density material 114 which can be, for example, a stiff or high density silicon or oil for providing support and security to the human foot as is discussed in more detail hereinbelow. Charging the lower enclosure 110 with the high density material 114 can be accomplished in a manner known in the art such as by injection and subsequent heat sealing of the plastic lower enclosure 110.

In the lower enclosure 110, the V-shaped top surface identified by the numeral 116 resembles the curvature or shape of a bowl or cradle when charged with the high density material 114 as is clearly shown in FIGS. 1 and 3. The V-shaped top surface 116 of the lower enclosure 110 is intended to support or cradle the vertically positioned upper flexible sealed enclosure 112 best shown in FIGS. 2 and 3. The back end or rear end of the lower enclosure 110 (adjacent to the back end of the outsole 106) is curved so that it exhibits the U-shape of a horseshoe as is clearly shown in FIG. 3 and also in FIG. 1. Thus, the V-shaped top surface 116 of the lower enclosure 110 resembles the shape of a cradle having a rounded U-shaped back end when viewed from the top in FIGS. 1 and 3. However, when viewed in section in FIG. 2, the lower enclosure 110 clearly exhibits a V-shape. This unique construction enables the formation of a U-shaped channel 118 which contains the high density material 114. The high density material 114 is enabled to flow in both directions through the channel 118 in response to the dynamic forces applied to the lower enclosure 110. This movement of the high density material 114 is illustrated by the flow arrows 120 of the high density material 114 clearly shown in FIGS. 1 and 3.

The upper flexible sealed enclosure 112 is also V-shaped, i.e., the bottom surface 122 of the upper enclosure 112 is V-shaped as is best shown in FIG. 2. The upper enclosure 112 can be comprised of any suitable material such as flexible plastic. The top surface 124 of the upper enclosure 112 is as wide as the longitudinal inner dimension of the outsole 106 as is clearly shown in FIGS. 1 and 2. The upper enclosure 112 is charged with a low density material 126 which can be, for example, a soft or low density silicon or oil or air for providing cushioning and shock absorption to the heel of the foot as is discussed in more detail hereinbelow. Charging the upper enclosure 112 with the low density material 126 can be accomplished in a manner known in the art such as by injection and subsequent heat sealing of the plastic upper enclosure 112.

The upper enclosure 11 2 having the V-shaped bottom surface 122 resembles an inverted triangular-shaped object once the upper enclosure 112 has been charged with the low density material 126. Reference to FIG. 2 will support this conclusion. The soft low density material 126 causes the V-shaped bottom surface 122 of the upper enclosure 112 to adopt a shape that enables it to be vertically cradled by the corresponding V-shaped top surface 116 of the lower enclosure 110. The upper enclosure 112 is then affixed to the lower enclosure 110 to form the dynamic dual density heel bag 100.

It is noted that the upper enclosure 112 can be affixed to the lower enclosure 110 in different ways. If the contents of the two separate and distinct enclosures are in solid form, i.e. , the upper enclosure 112 contains low density material 126 (such as soft silicon) and the lower enclosure 110 contains high density material 114 (such as hard silicon), then the two enclosures can be affixed by an adhesive. In the alternative, the two enclosures 110 and 112 can be affixed as by heat sealing together the flexible plastic envelopes that form the lower enclosure 110 and the upper enclosure 112. It is important to realize that the lower enclosure 110 and the upper enclosure 112 are separate enclosures and that the high density material 114 of the lower enclosure 110 is isolated from the low density material 126 of the upper enclosure 112. Thereafter, the heel bag 100, formed by the two separate, distinct and vertically stacked enclosures 110 and 112, is inserted into the outsole 106 of the athletic shoe 102 shown in FIG. 1. The heel bag 100 can merely be laid into the outsole 106 or be affixed to the interior surface of the outsole 106 with an adhesive.

A cross-sectional view of the dynamic dual density heel bag 100 is shown in FIG. 4 where the heel bag 100 is placed in the athletic shoe 102 shown in FIG. 1. The heel bag 100 is shown affixed to the interior surface of the outsole 106 with, for example, an adhesive (not shown). Since the crosssectional view of FIG. 4 is taken along the longitudinal axis of the athletic shoe 102 shown in FIG. 1, only a rear portion of the lower enclosure 110 is shown. That portion of the lower enclosure 110 shows a section of the U-shaped channel 118 which carries the high density material 114. The remainder of the interior of the outsole 106 shows the upper enclosure 112 of the heel bag 100 which is charged with the low density material 126. Extending forward of the outsole 106 is an inner sole 132 of the shoe 102.

Mounted above the outsole 106 and the inner sole 132 of the shoe 102 is a carbon fiber torsional spring insole 134 typically used with shoes having an elevated heel section 135 as shown in FIG. 4. The torsional spring insole 134 supports the heel of a foot and the inner sole 132 in communication with the elevated heel section 135 for providing torsional spring capability to the inner sole 132. A step-down region 136 is provided for connecting the elevated heel section 135 to the inner sole 132 for flexing the inner sole 132 in response to a pressure imbalance applied to the elevated heel section 135. The torsional spring insole 134 is the subject matter of U.S. Pat. No. 5,179,791 issued Jan. 19, 1993 and entitled Torsional Spring Insole And Method which is hereby incorporated by reference into this instant patent application. Mounted immediately above the torsional spring insole 134 and the inner sole 132 of the shoe 102 is a layer of ethylene vinyl acetate 138 known in the art as "EVA". The layer of EVA 138 is a lightweight cushioning material which is employed to absorb shock and cushion the foot in running and walking shoes. Positioned above the layer of EVA 138 and the elevated heel section 135 is a comfort flow removable sock 140 which is used to provide adequate ventilation to the foot.

The dynamics of the heel bag 100 will now be considered. The heel of the human foot is curved on the bottom. When walking, running or while exercising, an individual always lands of the heel of the foot. When the heel of the foot strikes the floor, the upper enclosure 112 and the lower enclosure 110 must provide support to the foot. When the foot strikes the floor, pressure is immediately applied to the upper enclosure 112 which contains the low density material 126. The pressure or force applied to the top surface 124 of the upper enclosure 112 is illustrated by a plurality of downward pointing arrows 142. The top surface 124 of the upper enclosure 112 is compressed and deformed into a concave shape as is illustrated by a dotted line 144 shown just beneath the top surface 124 in FIG. 2. The concave deformation in the upper enclosure 112 is in the shape of the heel of the foot and provides cushioning and shock absorption thereto.

When the heel strikes the floor, the deformation of the upper enclosure 112 containing the low density material 126 places a dynamic pressure on the lower enclosure 110 containing the high density material 114. The lower enclosure 110 is then compressed and generates pressure on the high density material 114. The high density material 114 in the lower enclosure 110 is caused to move through the U-shaped channel 118 as indicated by the flow arrows 120 in FIGS. 1 and 3. However, the high density material 114 is confined to the lower enclosure 110 and cannot escape. Thus, when the high density material 114 is compressed, it pushes back on the foot to provide support. It is noted that the direction of movement of the high density material 114 through the U-shaped channel 118 is controlled by the pressure applied and angle of the foot when it strikes the ground.

Since the V-shaped top surface 116 of the lower enclosure 110 cradles the upper enclosure 112, the deformation of the upper enclosure 112 causes the foot to be cradled by the lower enclosure 110. This design helps prevent sprained ankles because the lower enclosure 110 cannot roll within the stiff outsole 106 as shown in FIGS. 1 and 2. As a result, the foot is secured and also stabilized by the lower enclosure 110. Thus, when the foot steps-down onto the heel bag 100 of the present invention, the upper enclosure 112 containing the low density material 126 provides cushioning and shock absorption to the foot but does not provide adequate support. Consequently, the lower enclosure 110 containing the high density material 114 and incorporating the V-shaped top surface 116 and the stiff outsole 106 provides the support, security and stability necessary to protect the foot.

The present invention has been described in the form of a dynamic dual density heel bag 100 which is limited to the heel section of an athletic shoe 102 or other walking shoe as shown in FIGS. 1 and 4. However, it should be noted that the present invention can be modified to accommodate a design that incorporates a full size foot bag for supporting the entire foot and not just the heel of the foot during athletic and walking type activities. This modification would also include a lower enclosure 110 charged with a high density material 114 and a vertically stacked upper enclosure 112 charged with a low density material 126. However, the lower enclosure 110 and the upper enclosure 112 are expanded to accommodate the size of the entire foot. The low density material 126 would serve to provide cushioning and shock absorption and the high density material 114 would serve to provide support, security and stability to the entire foot. Furthermore, the high density material 114 would be isolated from the low density material 126.

Because the lower enclosure 110 is expanded to accommodate the entire human foot, the bottom of the lower enclosure 110 would be in the shape of a full-size foot. A shoe 102 that would accommodate a full-size foot bag would comprise the structural components that are typically included in, for example, athletic or walking shoes. However, the shoe construction shown in FIG. 4 herein would have to be modified to accommodate a full size foot bag. If the torsional spring insole 134 was to be utilized in the full size foot bag design, then the dimensions of the elevated heel section 135 and the angle of the step down region might be modified. This would provide more space for an inner sole portion 132 of the full size foot bag. Under these conditions, the layer of EVA 138 might be deleted in the presence of the inner sole portion 132 of the full size foot bag. As is clear from the foregoing, the full size foot bag is incorporated into the shoe construction during the manufacturing phase and thus is not an insert for preexisting shoes.

The present invention provides novel advantages over other shoe cushioning devices known in the art. A main advantage of the dynamic dual density heel bag 100 includes the combination of two separate and distinct enclosures where the upper enclosure 112 is charged with a low density material 126 for providing cushioning and shock absorption to the foot and the lower enclosure 110 is charged with a high density material 114 for providing support, security and stability to the foot. Thus, a single heel bag 100 provides both features. Other advantages include a simplified lightweight, robust construction that is incorporated into the original shoe construction. A rigid outsole 106 is employed to provide additional lateral support to prevent the lower enclosure 110 from rolling when exposed to side forces and a plurality of viewing windows are provided to determine if the lower enclosure 110 is charged with the high density material 114.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention. Accordingly,

What is claimed is:

1. A dynamic dual density heel bag for use in a shoe comprising:

a lower flexible sealed enclosure containing a high density material, said lower enclosure having a V-shaped top surface;

an upper flexible sealed enclosure containing a low density material, said upper enclosure having a V-shaped bottom surface for being vertically cradled by and affixed to said V-shaped top surface of said lower enclosure for forming a heel bag, said heel bag being affixed within an outsole of a shoe;

said high density material of said lower enclosure being isolated from said low density material of said upper enclosure, said low density material of said upper enclosure for providing cushioning and said high density material of said lower enclosure for providing support and stability to a foot.

2. The dynamic dual density heel bag of claim 1 wherein said high density material is comprised of high density silicon.

3. The dynamic dual density heel bag of claim 1 wherein said low density material is comprised of low density silicon.

4. The dynamic dual density heel bag of claim 1 wherein said lower enclosure is comprised of flexible plastic.

5. The dynamic dual density heel bag of claim 1 wherein said upper enclosure is comprised of flexible plastic.

6. The dynamic dual density heel bag of claim 1 wherein said upper enclosure is affixed to said lower enclosure by heat sealing.

7. The dynamic dual density heel bag of claim 1 wherein said upper enclosure is affixed to said lower enclosure by an adhesive.

8. The dynamic dual density heel bag of claim 1 wherein said heel bag is affixed within said outsole of said shoe by an adhesive.

9. The dynamic dual density heel bag of claim 1 wherein said lower flexible sealed enclosure is U-shaped and includes a channel for enabling said high density material to flow in response to dynamic compression applied to said heel bag.

10. The dynamic dual density heel bag of claim 1 wherein said upper flexible sealed enclosure is depressed in response to dynamic compression applied to said heel bag.

11. A dynamic dual density heel bag for use in a shoe comprising:

a lower flexible plastic, sealed enclosure containing a high density silicon material, said lower enclosure having a V-shaped top surface;

an upper flexible plastic, sealed enclosure containing a low density silicon material, said upper enclosure having a V-shaped bottom surface for being vertically cradled by and affixed to said V-shaped top surface of said lower enclosure for forming a heel bag, said heel bag being affixed within an outsole of a shoe;

said high density material of said lower enclosure being isolated from said low density material of said upper enclosure, said low density material of said upper enclosure for providing cushioning and said high density material of said lower enclosure for providing support and stability to a foot.

* * * * *